US011499288B2

(12) United States Patent
Maehara et al.

(10) Patent No.: US 11,499,288 B2
(45) Date of Patent: Nov. 15, 2022

(54) HYDRAULIC EXCAVATOR

(71) Applicant: Hitachi Construction Machinery Tierra Co., Ltd., Koka (JP)

(72) Inventors: Taihei Maehara, Koka (JP); Kiwamu Takahashi, Moriyama (JP); Takeshi Ishii, Shiga (JP)

(73) Assignee: Hitachi Construction Machinery Tierra Co., Ltd, Koka (JP)

( * ) Notice: Subject to any disclaimer, the term of this patent is extended or adjusted under 35 U.S.C. 154(b) by 367 days.

(21) Appl. No.: 16/649,706

(22) PCT Filed: Dec. 12, 2018

(86) PCT No.: PCT/JP2018/045664
§ 371 (c)(1),
(2) Date: Mar. 23, 2020

(87) PCT Pub. No.: WO2019/187378
PCT Pub. Date: Oct. 3, 2019

(65) Prior Publication Data

US 2020/0256032 A1 Aug. 13, 2020

(30) Foreign Application Priority Data

Mar. 29, 2018 (JP) ..... JP2018-064645

(51) Int. Cl.
*E02F 3/32* (2006.01)
*E02F 9/08* (2006.01)
(Continued)

(52) U.S. Cl.
CPC ..... *E02F 3/325* (2013.01); *E02F 9/0858* (2013.01); *E02F 9/0891* (2013.01); *E02F 9/16* (2013.01);
(Continued)

(58) Field of Classification Search
CPC ..... E02F 9/00–9/28; E02F 3/00–3/96; E02F 9/0858; E02F 9/0891; E02F 3/325;
(Continued)

(56) References Cited

U.S. PATENT DOCUMENTS 4,275,800 A * 6/1981 Batzel ..... B62D 33/067 180/326
5,638,908 A * 6/1997 Masumoto ..... E02F 9/024 280/638
8,162,087 B2 * 4/2012 Kobayashi ..... B60K 11/08 165/47
9,327,582 B2 * 5/2016 Matsumiya ..... B60H 1/00378
(Continued)

FOREIGN PATENT DOCUMENTS

JP 10-168928 A 6/1998
JP 2013-204361 A 10/2013
(Continued)

OTHER PUBLICATIONS

International Search Report (PCT/ISA/210) issued in PCT Application No. PCT/JP2018/045664 dated Mar. 5, 2019 with English translation (four (4) pages).
(Continued)

*Primary Examiner* — Edwin J Toledo-Duran
(74) *Attorney, Agent, or Firm* — Crowell & Moring LLP

(57) ABSTRACT

An upper revolving structure (4) of a hydraulic excavator (1) includes a revolving frame (7), a counterweight (8), an operator's seat (12), a right front cover (17B) disposed from the right side of the operator's seat (12) toward a front end side of the revolving frame (7), a control valve device (18), and an accumulator (21). An accumulator support device (23) is provided between the operator's seat (12) and the right front cover (17B), the accumulator support device (23) is configured by a box (24) providing the inside thereof for an accommodating space (25) and having an opening (26) and a lid member (28) mounted on the box (24) through a hinge member (29) and opened and closed between an open position at which the side of a free end (28D) opens the
(Continued)

opening (26) and a closed position at which the side of the free end (28D) closes the opening (26), and the accumulator (21) is mounted on the lid member (28).

4 Claims, 10 Drawing Sheets

(51) Int. Cl.

| | |
|---|---|
| ***E02F 9/16*** | (2006.01) |
| ***E02F 9/22*** | (2006.01) |
| ***E02F 9/26*** | (2006.01) |
| *E02F 3/96* | (2006.01) |

(52) U.S. Cl.
CPC ..... *E02F 9/2217* (2013.01); *E02F 9/2225* (2013.01); *E02F 9/26* (2013.01); *E02F 3/964* (2013.01)

(58) Field of Classification Search
CPC ..... E02F 9/16; E02F 9/2217; E02F 9/2225; E02F 9/26; E02F 3/964; E02F 9/0883; F15B 1/00–1/26; B60H 1/00378; B60H 1/32; B60H 1/3227
See application file for complete search history.

(56) References Cited

U.S. PATENT DOCUMENTS

| | | | | |
|---|---|---|---|---|
| 2005/0062239 | A1* | 3/2005 | Shore | B60G 17/056 280/124.159 |
| 2007/0131466 | A1* | 6/2007 | Gutzwiller | E02F 9/0841 180/311 |
| 2013/0152565 | A1 | 6/2013 | Ma et al. | |
| 2013/0255911 | A1 | 10/2013 | Matsumiya et al. | |
| 2015/0204049 | A1 | 7/2015 | Kanamaru et al. | |
| 2016/0222632 | A1 | 8/2016 | Kohzu et al. | |
| 2016/0273192 | A1 | 9/2016 | Kajita et al. | |
| 2017/0350093 | A1* | 12/2017 | Sewell | E02F 5/14 |

FOREIGN PATENT DOCUMENTS

| | | | |
|---|---|---|---|
| JP | 2015-501913 | A | 1/2015 |
| JP | 2015-59330 | A | 3/2015 |
| JP | 2015-90194 | A | 5/2015 |
| JP | 2015-135000 | A | 7/2015 |
| JP | 2016-188544 | A | 11/2016 |
| JP | 2017-193874 | A | 10/2017 |

OTHER PUBLICATIONS

Japanese-language Written Opinion (PCT/ISA/237) issued in PCT Application No. PCT/JP2018/045664 dated Mar. 5, 2019 (three (3) pages).

* cited by examiner

HYDRAULIC EXCAVATOR

TECHNICAL FIELD

The present invention relates to a hydraulic excavator including an accumulator collecting pressurized oil discharged from a hydraulic actuator and accumulating the pressure of the pressurized oil as hydraulic energy.

BACKGROUND ART

A hydraulic excavator as a typical construction machine is generally configured by a self-propelled lower traveling structure, an upper revolving structure mounted rotatably on the lower traveling structure through a revolving device, and a working mechanism provided on a front side of the upper revolving structure. The hydraulic excavator performs excavating work or the like by using the working mechanism while allowing the upper revolving structure to revolve.

The introduction of hydraulic excavators including an accumulator in a hydraulic circuit has recently been proposed in order to reduce the operational load on a hydraulic pump and efficiently reuse hydraulic energy during the operation of a hydraulic excavator (see e.g., Patent Documents 1 and 2).

Such hydraulic excavators including an accumulator are contrived to arrange a large-volume accumulator on an upper revolving structure. For instance, Patent Document 3 proposes the configuration of forming a recess in a counterweight to accommodate an accumulator in the recess. Patent Document 4 proposes the configuration of forming a support portion between a boom bracket provided with a working mechanism (boom) and an engine hood to support an accumulator at the support portion. Patent Document 5 proposes the configuration of locating an accumulator between a front vertical plate which constitutes a revolving frame of an upper revolving structure and a control valve (valve block) to mount the accumulator on the front vertical plate.

PRIOR ART DOCUMENT

Patent Document

Patent Document 1: Japanese Patent Laid-Open No. 2015-501913 A

Patent Document 2: Japanese Patent Laid-Open No. 2015-090194 A

Patent Document 3: Japanese Patent Laid-Open No. 2015-059330 A

Patent Document 4: Japanese Patent Laid-Open No. 2016-188544 A

Patent Document 5: Japanese Patent Laid-Open No. 2017-193874 A

SUMMARY OF THE INVENTION

Herein, the inventions in Patent Documents 3 and 4 relate to middle-sized hydraulic excavators, and each of the middle-sized hydraulic excavators includes a large counterweight and a large equipment accommodation space formed on a revolving frame of an upper revolving structure. Advantageously, such middle-sized hydraulic excavators can readily secure space for disposing an accumulator on the upper revolving structure. However, in small-sized hydraulic excavators used in excavating work in narrow areas such as urban districts, an upper revolving structure is formed in a compact size such that a rear end (a rear surface of a counterweight) thereof can revolve within a vehicle width of a lower traveling structure. Thus, such small-sized hydraulic excavators unfortunately fail to secure space for disposing an accumulator on the upper revolving structure.

On the other hand, a hydraulic excavator according to the invention in Patent Document 5 is configured to include an accumulator disposed on a lower side of a floor sheet of an upper revolving structure by mounting the accumulator on a front vertical plate of a revolving frame. Disadvantageously, the efficiency of maintenance operation such as regular filling of a filler gas in an accumulator can decline.

The present invention is made in view of the aforementioned problems of the prior art and has an object to provide a hydraulic excavator capable of including an accumulator disposed in a narrow space of an upper revolving structure and improving the efficiency of maintenance operation for the accumulator.

In order to solve the aforementioned problems, the present invention is applied to a hydraulic excavator including: a self-propelled lower traveling structure; an upper revolving structure mounted rotatably on the lower traveling structure; and a working mechanism mounted tiltably on a front side of the upper revolving structure; the upper revolving structure including: a revolving frame on whose front side the working mechanism is mounted; an operator's seat disposed on a front side of the revolving frame; a right front cover disposed from the right side of the operator's seat toward a front end side of the revolving frame and covering equipment mounted on the revolving frame; a control valve device controlling supply and discharge of pressurized oil to a plurality of hydraulic actuators provided on the lower traveling structure, the upper revolving structure and the working mechanism; and an accumulator accumulating the pressure of the pressurized oil discharged from at least one hydraulic actuator in the plurality of hydraulic actuators and having a pressurized oil supply and discharge port connected to the control valve device.

A feature of the present invention is that an accumulator support device supporting the accumulator is provided between the operator's seat and the right front cover, the accumulator support device is configured by a box providing the inside thereof for an accommodating space accommodating the accumulator and having an opening taking the accumulator in and out of the accommodating space and a lid member whose one end is rotatably connected to the box by a connecting member and opened and closed between an open position at which the opening is opened and a closed position at which the opening is closed, and the accumulator is configured to be mounted on the lid member in the state where the pressurized oil supply and discharge port is disposed on the connecting member side.

According to the present invention, the accumulator can be disposed by effectively using a narrow space of the upper revolving structure by providing the accumulator support device between the operator's seat and the right front cover. Further, the accumulator can be guarded from earth and sand or the like at the time of excavating work by accommodating the accumulator in the box in the state where the lid member of the accumulator support device is at the closed position. Meanwhile, the efficiency of maintenance operation for the accumulator can be improved by taking the accumulator out of the box in the state where the lid member is at the open position.

MODE FOR CARRYING OUT THE INVENTION

Figure 1:
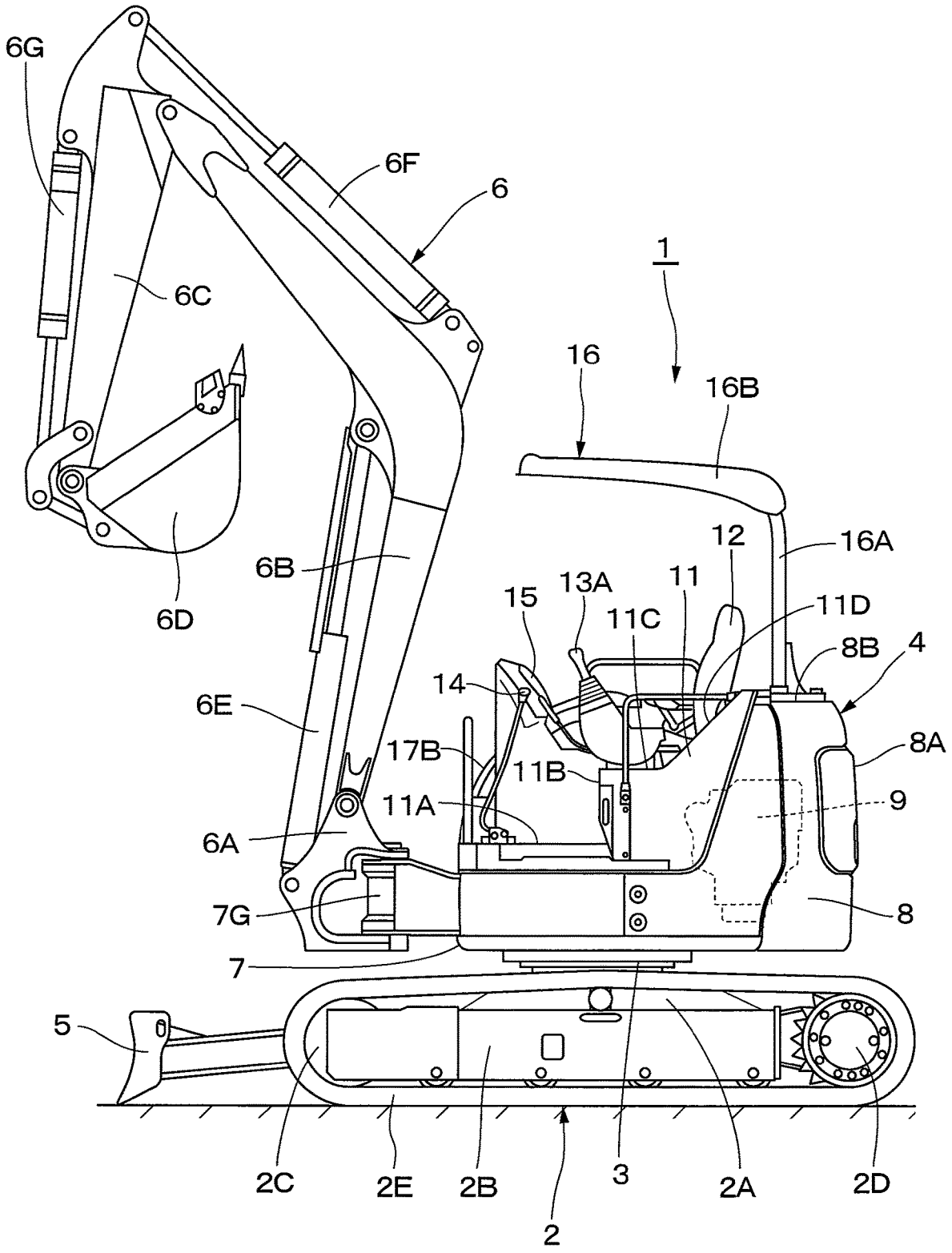
FIG. 1 is a front view showing a hydraulic excavator applied to a first embodiment of the present invention.

A rear small-revolving type hydraulic excavator is exemplified as a hydraulic excavator according to an embodiment of the present invention, and will be described below in detail by referring to FIGS. 1 to 10.

FIGS. 1 to 7 illustrate a first embodiment of the present invention. A hydraulic excavator 1 is preferably used in excavating work or the like in e.g., urban districts, and includes a self-propelled crawler-type lower traveling structure 2 and an upper revolving structure 4 mounted on the lower traveling structure 2 through a revolving device 3. A working mechanism 6 is provided on a front side of the upper revolving structure 4. The revolving device 3 is provided with a revolving hydraulic motor (not shown) as a hydraulic actuator to allow the upper revolving structure 4 to revolve on the lower traveling structure 2.

The lower traveling structure 2 includes a truck frame 2A that is to be a base of the lower traveling structure 2, and the truck frame 2A includes a pair of right and left side frames 2B (illustrated only on the left side) in the right-and-left direction extending in a front-and-rear direction. An idler wheel 2C is provided on one side in a front-and-rear direction of the right and left side frames 2B, and a drive wheel 2D is provided on the other side in the front-and-rear direction. The drive wheel 2D is driven by a traveling hydraulic motor (not shown) as a hydraulic actuator, and a crawler belt 2E is wound around the idler wheel 2C and the drive wheel 2D. The lower traveling structure 2 drives the crawler belt 2E by the drive wheel 2D to travel in uneven work sites stably. The truck frame 2A of the lower traveling structure 2 is provided with a blade device 5 removing earth and sand or the like when the lower traveling structure 2 travels.

The working mechanism 6 includes a swing post 6A capable of swinging mounted in the right-and-left direction at an front end of the revolving frame 7 which will be described later, a boom 6B capable of moving upward and downward mounted on the swing post 6A, an arm 6C mounted tiltably on a tip end of the boom 6B, and a bucket 6D mounted tiltably on a tip end of the arm 6C. The working mechanism 6 includes a boom cylinder 6E, an arm cylinder 6F, and a bucket cylinder 6G, each as a hydraulic actuator. A swing cylinder (not shown) swinging the swing post 6A in the right-and-left direction is provided between the revolving frame 7 and the swing post 6A.

The upper revolving structure 4 is configured to include a revolving frame 7, a counterweight 8, an engine 9, an operator's seat 12, an exterior cover 17, a control valve device 18, an accumulator 21, and an accumulator support device 23 which will be described later. Herein, in the rear small-revolving type hydraulic excavator 1, the upper revolving structure 4 is formed in a compact size such that a rear surface 8A of the counterweight 8 is accommodated within a right and left vehicle width dimension of the lower traveling structure 2 when the upper revolving structure 4 revolves. By definition, the rear small-revolution is performed in the range of operational allowance including the case where part of the counterweight 8 is even slightly beyond the vehicle width dimension of the lower traveling structure 2.

Figure 2:
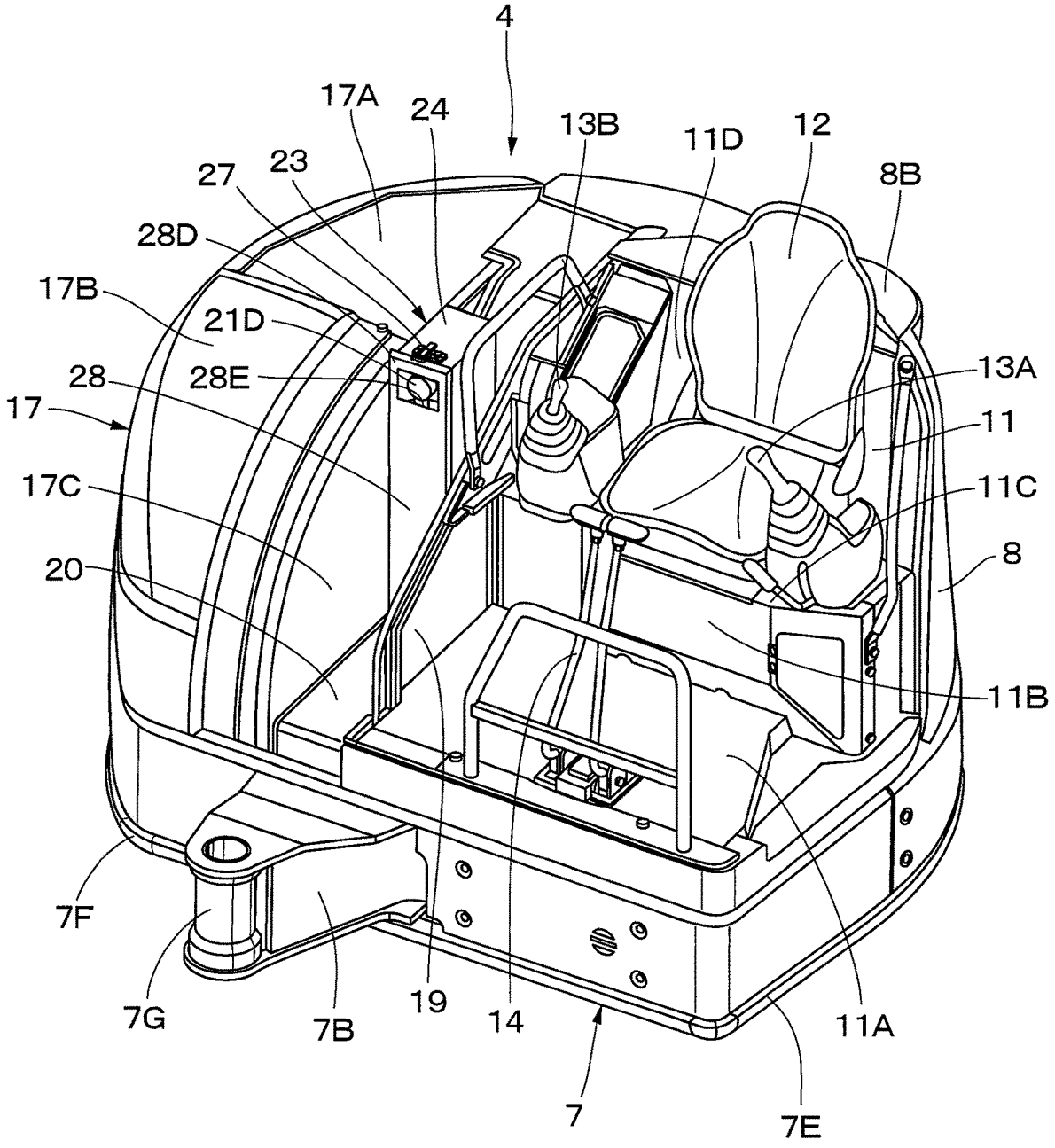
FIG. 2 is a perspective view of an upper revolving structure in a state where a working mechanism, a canopy and the like are removed and a lid member of an accumulator support device is at a closed position.
Figure 3:
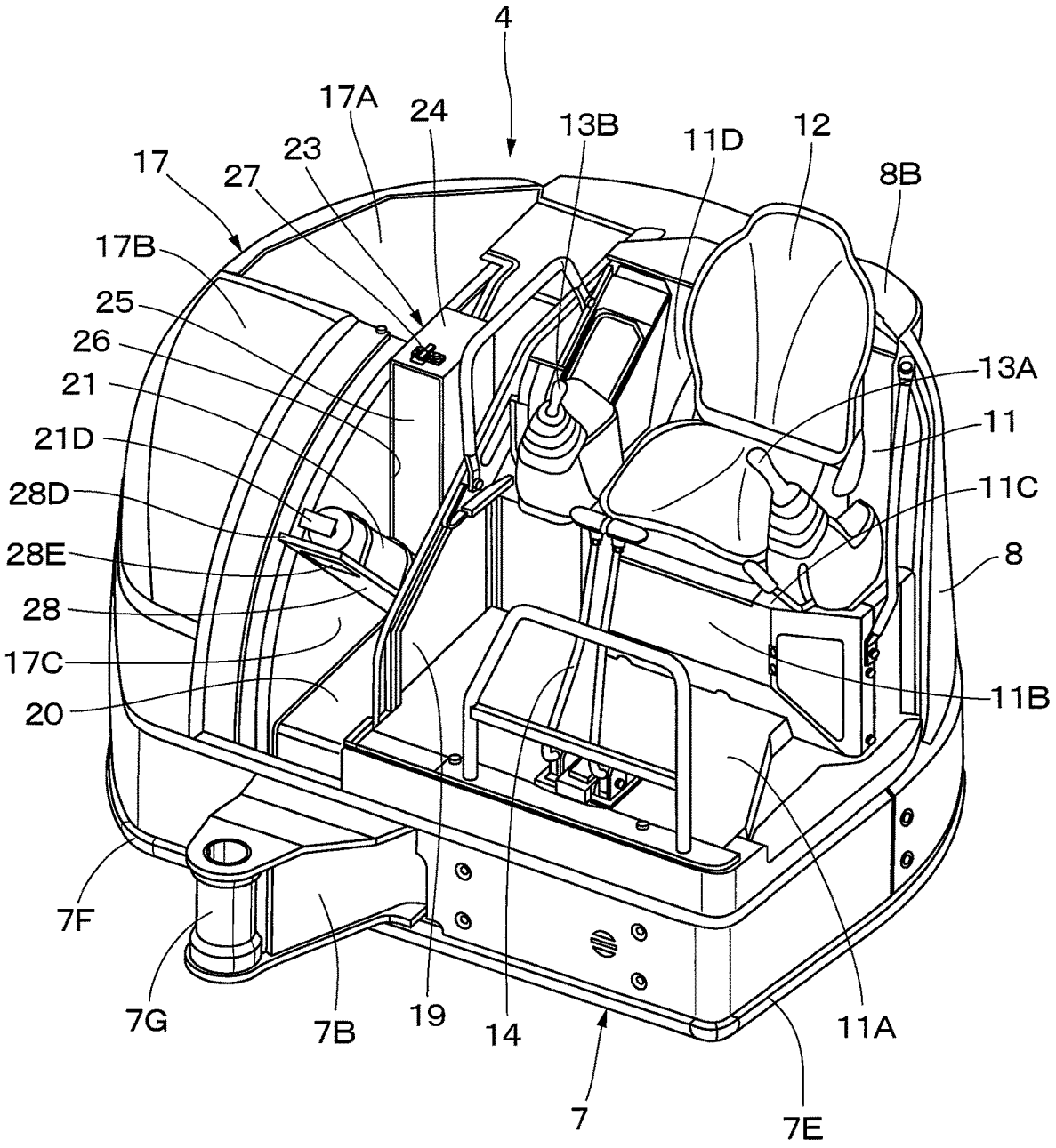
FIG. 3 is a perspective view of the upper revolving structure in a state where the working mechanism, the canopy and the like are removed and the lid member of the accumulator support device is at an open position.
Figure 4:
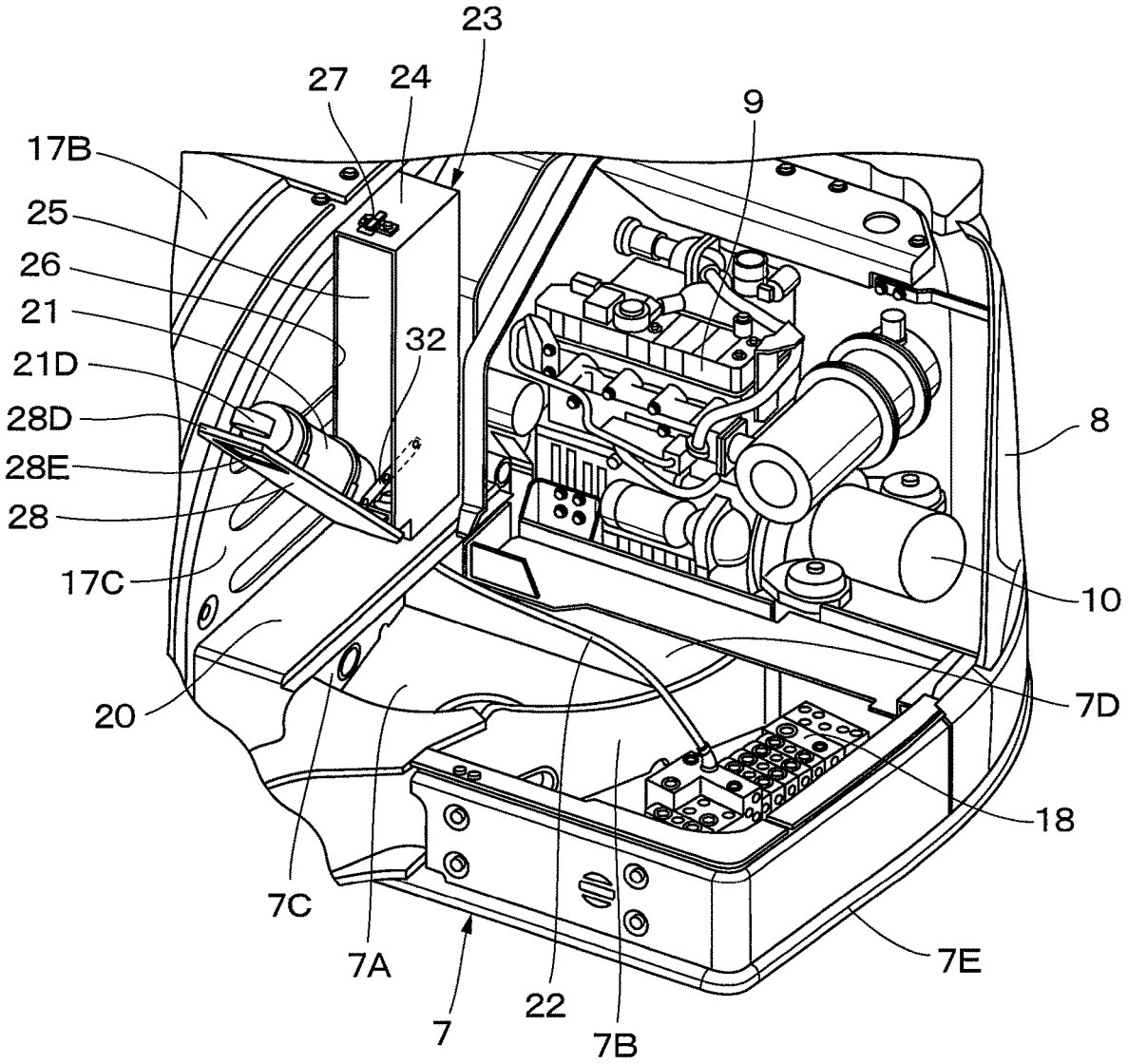
FIG. 4 is a perspective view of a revolving frame, an engine, a control valve device, the accumulator, a hydraulic hose and the like of the upper revolving structure.

The revolving frame 7 is to be a base of the upper revolving structure 4, and is mounted on the lower traveling structure 2 through the revolving device 3. As shown in FIGS. 2 to 4, the revolving frame 7 includes a bottom plate 7A extending in a front-and-rear direction, a left vertical plate 7B and a right vertical plate 7C installed upright on the bottom plate 7A faced with each other in the right-and-left direction and extending in a front-and-rear direction, and a lateral plate 7D. The lateral plate 7D is installed upright on the bottom plate 7A and extends in the right-and-left direction to connect the left and right vertical plates 7B, 7C. A left side frame 7E is provided leftward from the bottom plate 7A, and the left side frame 7E extends in a curved manner from a front end portion to a rear end side of the bottom plate 7A. A right side frame 7F is provided rightward from the bottom plate 7A, and the right side frame 7F extends in a curved manner from a front end portion to a rear end side of the bottom plate 7A. In addition, a cylindrical support bracket 7G is provided at front end portions of the left and right vertical plates 7B, 7C. The swing post 6A of the working mechanism 6 is supported capable of swinging to the support bracket 7G in the right-and-left direction.

The counterweight 8 is provided on a rear side of the revolving frame 7 to take a weight balance with the working mechanism 6. The counterweight 8 is formed as an arc-shaped heavy article, i.e., a center part in the right-and-left direction projecting rearward. The outer peripheral surface (rear surface) 8A on a rear side of the counterweight 8 is accommodated within the vehicle width dimension in the right-and-left direction of the lower traveling structure 2 when the upper revolving structure 4 revolves, and interference of nearby obstacles can be avoided when the upper revolving structure 4 revolves. As a result, the hydraulic excavator 1 achieves rear small-revolution of the upper revolving structure 4. Meanwhile, a canopy mounting platform 8B is provided on an upper surface of the counterweight 8, and a canopy 16 which will be described later is mounted on the canopy mounting platform 8B.

The engine 9 as a prime mover is located on a front side of the counterweight 8 and provided on the revolving frame 7. The engine 9 is located closer to a rear side than the lateral plate 7D of the revolving frame 7, mounted on the left and right vertical plates 7B, 7C, and extends in the right-and-left direction. A hydraulic pump 10 is provided on the left side of the engine 9, and the hydraulic pump 10 is driven by the engine 9 to discharge pressurized oil to the control valve device 18 which will be described later. The prime mover may be an electric motor, or a hybrid-type prime mover including an engine and an electric motor in combination.

A floor member 11 is provided closer to the left side of the upper side revolving frame 7 in the state where the floor member 11 covers a front side and an upper side of the engine 9. The floor member 11 is configured to include a foot rest section 11A for an operator to place a foot, a rising portion 11B upwardly rising from a rear portion of the foot rest section 11A, an operator's seat mounting section 11C extending from an upper end to a rear side of the rising portion 11B through an upper side of the engine 9, and a back plate portion 11D extending diagonally upward from a rear end of the operator's seat mounting section 11C.

The operator's seat 12 is disposed on the front side of the counterweight 8 and on the upper side of the engine 9. That is, the operator's seat 12 is provided on the operator's seat mounting section 11C which constitutes the floor member 11, and is seated by an operator operating the hydraulic excavator 1. A left operating lever 13A and a right operating lever 13B operating the revolving device 3 and the working mechanism 6 or the like are disposed on both right and left sides of the operator's seat 12. A traveling lever-pedal 14 operated by manual operation or foot depressing operation when the lower traveling structure 2 travels is provided on a front side of the foot rest section 11A of the floor member 11 located forward from the operator's seat 12. Further, a monitor device 15 displaying information such as the state of operation, settings, and alarm on the hydraulic excavator 1 for an operator is provided on a front side of the right operating lever 13B (see FIG. 1).

The canopy 16 is mounted on the canopy mounting platform 8B of the counterweight 8 to cover the operator's seat 12 from an upper side. The canopy 16 is configured as a 2-strut type canopy to include right and left columns 16A (only the left side illustrated) installed upright on the canopy mounting platform 8B at an interval in the right-and-left direction and a roof 16B provided on the upper end side of the right and left columns 16A. In this embodiment, a canopy type hydraulic excavator 1 including a canopy 16 is exemplified, but the canopy 16 may be substituted by a cab.

The exterior cover 17 is provided on the right side of the upper revolving structure 4. The exterior cover 17 covers onboard equipment mounted on the right side of the revolving frame 7 such as a heat exchanger, a hydraulic oil tank, and a fuel tank (each not shown). The exterior cover 17 includes a right rear cover 17A covering a heat exchanger or the like disposed on the right side of the engine 9 and a right front cover 17B provided capable of being opened and closed on a front side of the right rear cover 17A and covering the hydraulic oil tank and the fuel tank or the like. The right front cover 17B is disposed in the range of the right side of the operator's seat 12 to a front end of the revolving frame 7, and includes an arc-shaped inclined surface that inclines so as to be gradually lower forward. A right front partition cover 17C covering the right front cover 17B from the left side is provided leftward from the right front cover 17B. The right front partition cover 17C constitutes part of the right front cover 17B to cover the hydraulic oil tank and the fuel tank or the like from the left side.

The control valve device 18 is provided on a left front side of the revolving frame 7. That is, the control valve device 18 is disposed closer to the front side than the lateral plate 7D of the revolving frame 7 and closer to the left side than the left vertical plate 7B. The control valve device 18 is composed of an assembly of a plurality of directional control valves, and controls the supply and discharge of pressurized oil to and from the hydraulic pump 10 for a plurality of hydraulic actuators such as a traveling hydraulic motor (not shown) of the lower traveling structure 2, a revolving hydraulic motor (not shown) of the revolving device 3, and each of the cylinders 6E, 6F, 6G of the working mechanism 6. The accumulator 21 which will be described later is connected to the control valve device 18 by a hydraulic hose 22.

Herein, a monitor mounting plate 19 mounting the monitor device 15 is provided on the left side of the right front partition cover 17C which constitutes the exterior cover 17. The monitor mounting plate 19 upwardly rises from the foot rest section 11A of the floor member 11, and is faced with the right front partition cover 17C of exterior cover 17 at an interval in the right-and-left direction. A support base plate 20 disposed on the same plate as the foot rest section 11A of the floor member 11 is provided by extending in a front-and-rear direction between the right front partition cover 17C of the exterior cover 17 and the monitor mounting plate 19. The accumulator support device 23 which will be described later is mounted on the support base plate 20. The support base plate 20 is disposed between a right side surface of a cab and the right front partition cover 17C of the exterior cover 17 when the canopy 16 is substituted by a cab to be mounted on the revolving frame 7.

The accumulator 21 is provided between the right front cover 17B of the exterior cover 17 and the operator's seat 12 through the accumulator support device 23 which will be described later. The accumulator 21 accumulates the pressure of pressurized oil discharged from at least one hydraulic actuator in a plurality of hydraulic actuators such as a traveling hydraulic motor (not shown) of the lower traveling structure 2, a revolving hydraulic motor (not shown) of the revolving device 3, and each of the cylinders 6E, 6F, 6G of the working mechanism 6.

Figure 6:
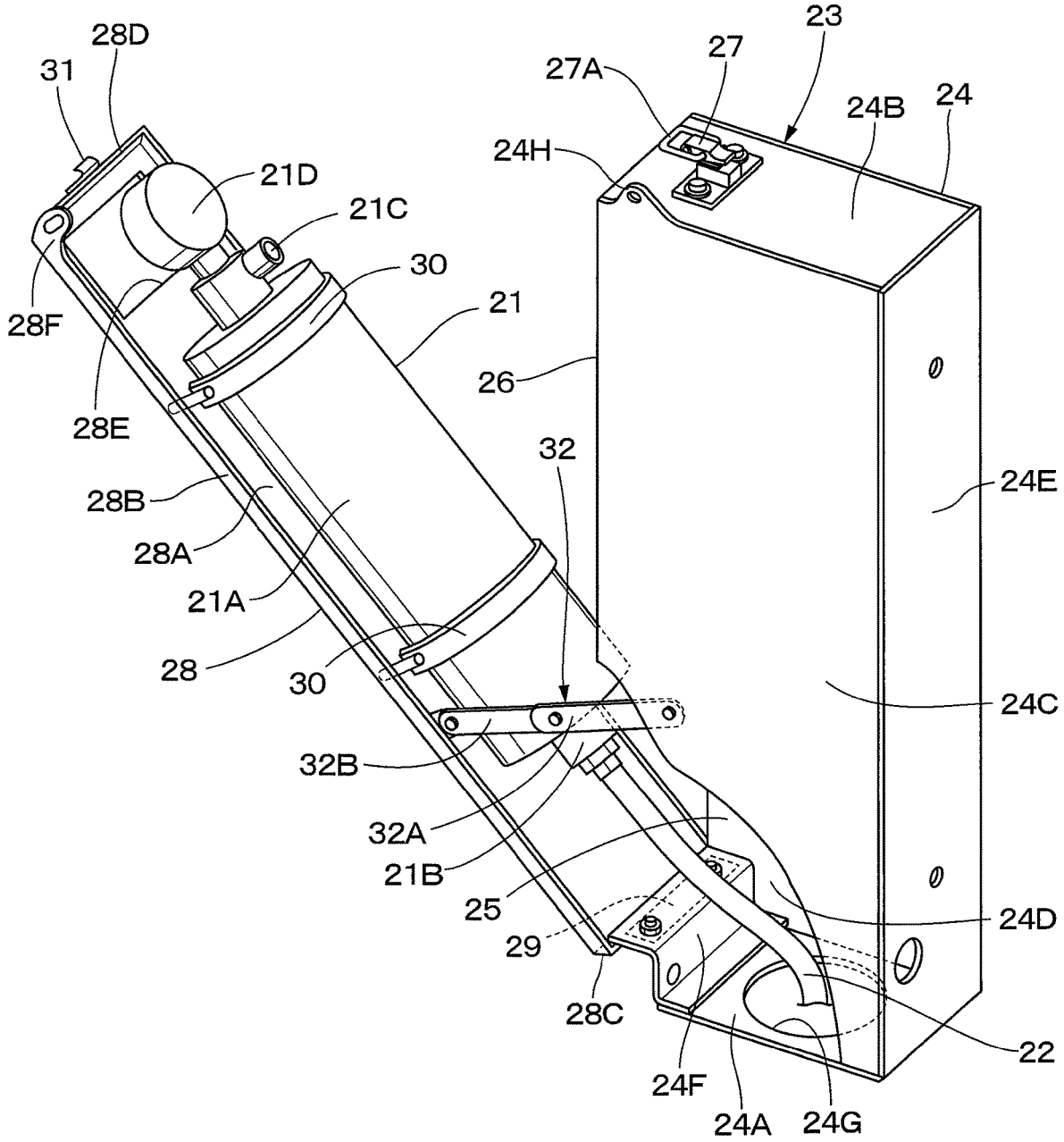
FIG. 6 is a partially sectioned perspective view of the accumulator support device and the accumulator in a state where the lid member is at the open position.

As shown in FIG. 6, the accumulator 21 is composed of a piston type accumulator or the like, and includes a cylindrical case 21A and a piston partitioning the case 21A into a gas chamber and an oil chamber (each not shown), and a filler gas such as nitrogen gas is filled in the gas chamber. A pressurized oil supply and discharge port 21B supplying and discharging pressurized oil to the oil chamber is provided on one end side in the axial direction of the case 21A (in the length direction). A gas filling port 21C filling a filler gas in the gas chamber and a pressure gauge 21D displaying the pressure of the filler gas filled in the gas chamber are provided on the other end side in the axial direction of the case 21A.

One end of the hydraulic hose 22 is connected to the pressurized oil supply and discharge port 21B of the accumulator 21, and the other end of the hydraulic hose 22 is connected to the control valve device 18 (see FIG. 4). Therefore, the accumulator 21 is connected to a hydraulic circuit driving a plurality of hydraulic actuators mounted on the hydraulic excavator 1 through the hydraulic hose 22. The accumulator 21 accumulates the pressure of pressurized oil in the oil chamber discharged from at least one hydraulic actuator in the plurality of hydraulic actuator to a tank, and the gas chamber is compressed by the oil amount corresponding to the pressure accumulated in the oil chamber. The accumulator 21 needs regular maintenance operation to refill a filler gas in a gas chamber. The filler gas is refilled by connecting the gas filling port 21C of the accumulator 21 and a gas cylinder of the filler gas by a hose (each not shown).

Subsequently, the accumulator support device 23 used in this embodiment will be described.

Figure 5:
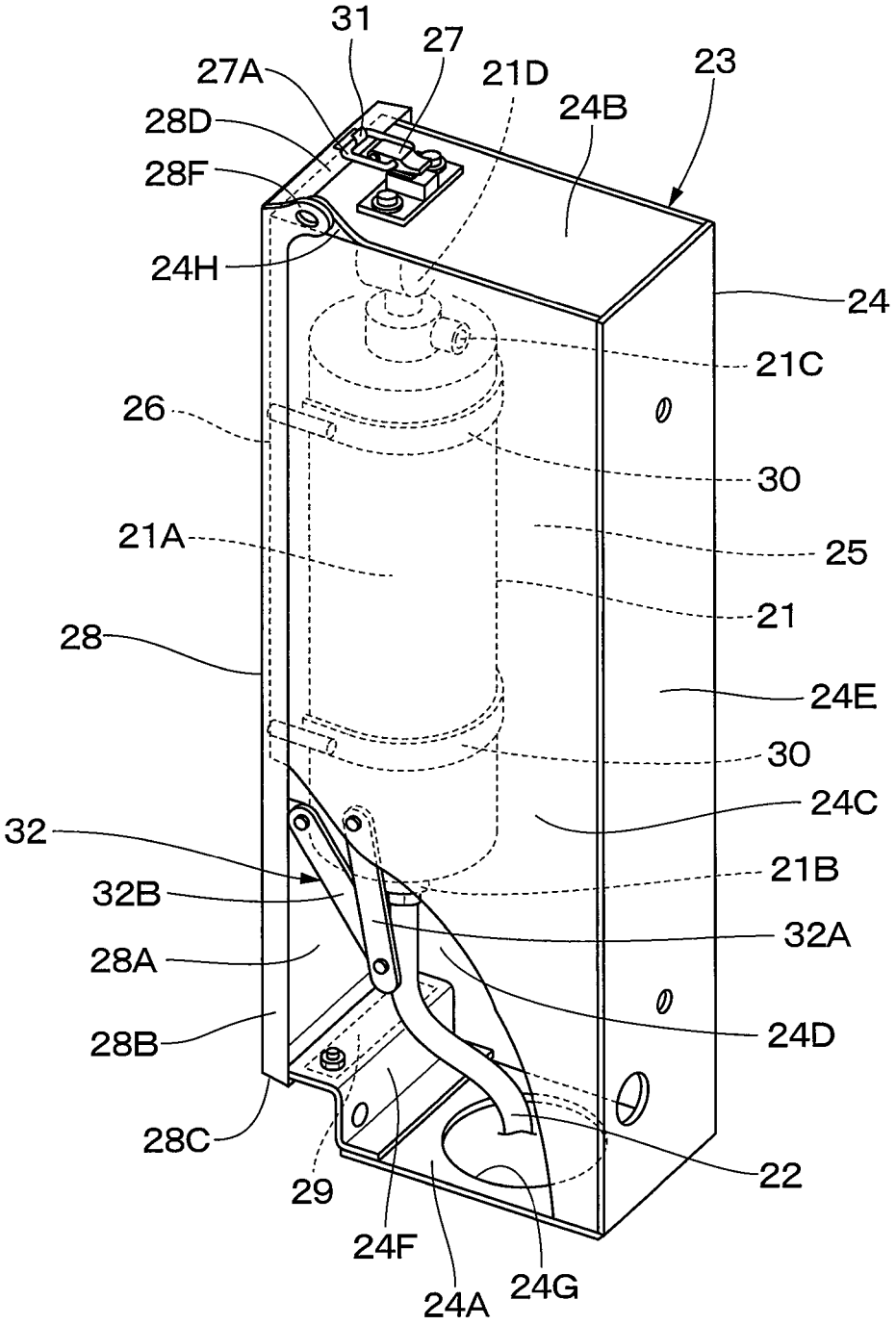
FIG. 5 is a partially sectioned perspective view of the accumulator support device and the accumulator in a state where the lid member is at the closed position.

The accumulator support device 23 is provided by extending perpendicular to the vertical direction between the right front cover 17B of the exterior cover 17 and the operator's seat 12. More specifically, the accumulator support device 23 is disposed on the support base plate 20 mounted between the right front partition cover 17C and the monitor mounting plate 19. The accumulator support device 23 supports the accumulator 21 on the support base plate 20, and as shown in FIGS. 5 and 6, is configured by a box 24 and a lid member 28 which will be described later.

The box 24 is to be a base of the accumulator support device 23, and is fixed on an upper surface of the support base plate 20 and extends upwardly. The box 24 is formed as a long rectangular shape in the vertical direction by a bottom plate 24A abutting on the support base plate 20, an upper surface plate 24B faced with the bottom plate 24A in the vertical direction, a left side plate 24C, a right side plate 24D, and a rear plate 24E. The left and right side plates 24C, 24D are faced with each other at an interval in the right-and-left direction to connect the bottom plate 24A and the upper surface plate 24B. The rear plate 24E is fixed at rear ends of the bottom plate 24A, the upper surface plate 24B, and the left and right side plates 24C, 24D. A stepped portion 24F bent upward and forward having an L-shape is formed on a front side of the bottom plate 24A, and a fixing piece 29A of a hinge member 29 which will be described later is mounted on the stepped portion 24F.

The box 24 provides the inside thereof for an accommodating space 25, and the accumulator 21 is accommodated in the accommodating space 25. One surface side opposite to the rear plate 24E of the box 24 is a rectangular-shaped opening 26 surrounded by front ends of the stepped portion 24F, the upper surface plate 24B, the left and right side plates 24C, 24D of the bottom plate 24A. The accumulator 21 is taken in and out of the accommodating space 25 through the opening 26. A hose insertion hole 24G is formed on the bottom plate 24A of the box 24, and the hydraulic hose 22 connecting the accumulator 21 and the control valve device 18 is inserted into the hose insertion hole 24G. Meanwhile, a snap lock 27 having a clasp 27A is mounted on a front side of the upper surface plate 24B which constitutes the box 24 (the opening 26 side). A box side projecting piece 24H having a bolt insertion hole is provided on a front side of an upper end portion of the left side plate 24C which constitutes the box 24.

Figure 7:
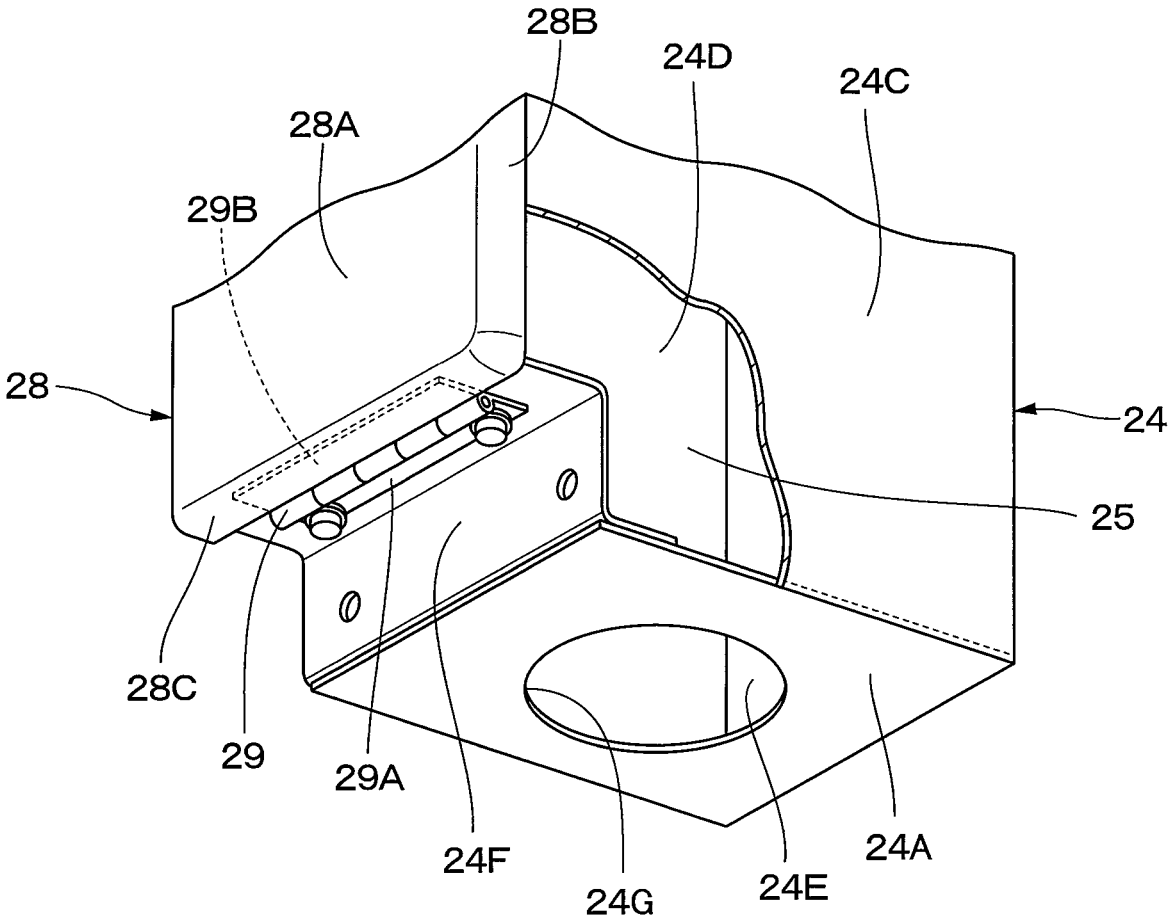
FIG. 7 is a perspective view of a hinge member provided between a box and the lid member.

The lid member 28 is mounted on the box 24 capable of opening and closing the opening 26. The lid member 28 is configured by a body portion 28A composed of a rectangular plate slightly larger than the opening 26 of the box 24 and a peripheral wall section 28B surrounding the periphery of the body portion 28A and projected on the box 24 side. A rotating end 28C is at one end in the length direction of the lid member 28 (lower end), and the rotating end 28C and the stepped portion 24F of the box 24 are connected by the hinge member 29 as a connecting member. As illustrated in FIG. 7, the hinge member 29 includes a fixing piece 29A mounted on the stepped portion 24F of the box 24 and a rotational piece 29B capable of rotating relative to the fixing piece 29A, and the rotational piece 29B is mounted on the rotating end 28C of the lid member 28.

As described above, the lid member 28 is mounted on the box 24 through the hinge member 29. A free end 28D is opposite to the rotating end 28C in the length direction of the lid member 28. The free end 28D side of the lid member 28 can rotate around the center of hinge member 29 between a closed position at which the opening 26 of the box 24 is closed (positions in FIGS. 2 and 5) and an open position at which the opening 26 is opened (positions in FIGS. 3 and 6).

The accumulator 21 is fixed on an inner surface in the body portion 28A of the lid member 28 as the box 24 side using a plurality of (e.g., 2) fixing bands 30. Therefore, the accumulator 21 is accommodated in the accommodating space 25 of the box 24 when the lid member 28 is at the closed position, and the accumulator 21 is taken out of the box 24 through the opening 26 when the lid member 28 is at the open position.

In this case, the accumulator 21 is mounted on the lid member 28 in the state where the pressurized oil supply and discharge port 21B is disposed on the hinge member 29 side. The hydraulic hose 22 connected to the pressurized oil supply and discharge port 21B of the accumulator 21 extends toward the control valve device 18 through the hose insertion hole 24G formed on the bottom plate 24A of the box 24 and a hose insertion hole (not shown) formed on the support base plate 20 (see FIG. 4). As a result, high deformation of the hydraulic hose 22 connected to the pressurized oil supply and discharge port 21B of the accumulator 21 can be suppressed to guard the hydraulic hose 22 even if the free end 28D of the lid member 28 rotates around the center of the hinge member 29 between the closed position and the open position.

Meanwhile, a rectangular opening 28E is formed at a position corresponding to the pressure gauge 21D in the body portion 28A of the lid member 28 in the state where the accumulator 21 is mounted on the lid member 28. As a result, the pressure gauge 21D of the accumulator 21 can visually be confirmed from the outside of the box 24 through the opening 28E of the lid member 28 even if the lid member 28 is at the closed position to accommodate the accumulator 21 in the accommodating space 25 of the box 24. Therefore, the accumulator 21 is configured to allow the pressure of a filler gas filled in the gas chamber of the accumulator 21 to be readily confirmed.

A hook 31 corresponding to the snap lock 27 mounted on the upper surface plate 24B of the box 24 is fixed at the free end 28D of the lid member 28. The clasp 27A of the snap lock 27 is latched on the hook 31 when the lid member 28 is at the closed position as shown in FIG. 5. As a result, the lid member 28 can be fixed at the closed position.

A lid member side projecting piece 28F having a bolt insertion hole is provided at a position corresponding to the box side projecting piece 24H provided on the left side plate 24C of the box 24 in the free end 28D of the lid member 28. As shown in FIG. 5, the lid member side projecting piece 28F and the box side projecting piece 24H of the box 24 are directly opposed to each other when the lid member 28 is at the closed position. In this state, bolts are inserted through a bolt insertion hole of the lid member side projecting piece 28F and a bolt insertion hole of the box side projecting piece 24H to be screwed with nuts (each not shown), thereby fixing the lid member 28 at the closed position.

The link mechanism 32 as an open position retaining mechanism is provided between the box 24 and the lid member 28 to hold the lid member 28 at the open position. The link mechanism 32 includes a box side link 32A whose proximal end side is mounted rotatably on the left side plate 24C of the box 24 and a lid member side link 32B whose proximal end side is rotatably mounted on the peripheral wall section 28B on the left side of the lid member 28, and a front end side of the box side link 32A and a front end side of the lid member side link 32B are rotatably connected.

The link mechanism 32 is folded between the box 24 and the lid member 28 when the lid member 28 is at the closed position shown in FIG. 5. On the other hand, the box side link 32A and the lid member side link 32B of the link mechanism 32 linearly extend between the box 24 and the lid member 28, and holds the extension by a stopper (not shown) when the lid member 28 is rotated to the open position shown in FIG. 6. As a result, the lid member 28 on which the accumulator 21 is mounted can be held at the open position by the link mechanism 32. Therefore, the state where the gas filling port 21C of the accumulator 21 is taken out of the box 24 can be held, and the accumulator 21 is configured to improve the operational efficiency of maintenance such as refilling of a filler gas in the gas chamber of the accumulator 21 through the gas filling port 21C.

The hydraulic excavator 1 according to the first embodiment is configured as described above, and the operation will be described.

First, an operator gets on the upper revolving structure 4 with the foot rest section 11A of the floor member 11 as a foothold, and is seated in the operator's seat 12. The operator seated in the operator's seat 12 operates the traveling lever-pedal 14 to allow the lower traveling structure 2 to travel and the hydraulic excavator 1 to be self-propelled to a desired work area. Then, the operator operates the revolving device 3 and the working mechanism 6 by the left and right operating levers 13A, 13B. As a result, the hydraulic excavator 1 allows the upper revolving structure 4 to revolve and the working mechanism 6 to move upward and downward to perform excavating work or the like for earth and sand.

The accumulator 21 accumulates the pressure of pressurized oil in the oil chamber discharged from at least one hydraulic actuator in a plurality of hydraulic actuators to a tank during the operation of the hydraulic excavator 1. Then, the pressure of the pressurized oil accumulated in the accumulator 21 is released into the hydraulic circuit accordingly, thereby e.g., aiding in operating the hydraulic actuator.

Herein, in the hydraulic excavator 1 according to the first embodiment, the accumulator support device 23 including the box 24 and the lid member 28 is provided between the operator's seat 12 and the right front cover 17B of the exterior cover 17. The accumulator 21 is supported by the lid member 28 of the accumulator support device 23. As a result, a narrow space formed between the operator's seat 12 and the right front cover 17B can effectively be used to dispose the accumulator 21 even if the upper revolving structure 4 is formed in a compact size to achieve rear small-revolution.

The lid member 28 of the accumulator support device 23 is disposed at a closed position and the clasp 27A of the snap lock 27 provided on the upper surface plate 24B of the box 24 is latched on the hook 31 provided at the free end 28D of the lid member 28 when the hydraulic excavator 1 is operated (see FIG. 5). As a result, the lid member 28 of the accumulator support device 23 can be held at the closed position. As described above, the lid member 28 of the accumulator support device 23 is held at the closed position to accommodate the accumulator 21 in the accommodating space 25 of the box 24 when the hydraulic excavator 1 is operated.

Thus, collision of earth and sand or the like with the accumulator 21 can be suppressed to guard the accumulator 21 even if part of such earth and sand or the like excavated by the working mechanism 6 falls from the bucket 6D. Bolts are inserted into a bolt insertion hole of the box side projecting piece 24H provided on the box 24 and a bolt insertion hole of the lid member side projecting piece 28F provided on the lid member 28 in the state where the lid member 28 is disposed at the closed position. Therefore, the lid member 28 can reliably be held at the closed position regardless of vibration or the like when the hydraulic excavator 1 is operated when nuts are screwed with the bolts.

Meanwhile, the opening 28E is provided on the free end 28D side of the lid member 28, and the pressure gauge 21D of the accumulator 21 accommodated in the accommodating space 25 of the box 24 can visually be confirmed from the outside of the box 24 through the opening 28E. Thus, the pressure of the filler gas filled in the accumulator 21 can readily be confirmed by the pressure gauge 21D. Therefore, a filler gas such as nitrogen gas can promptly be refilled in the accumulator 21 when the pressure of the filler gas declines.

Herein, the snap lock 27 provided on the upper surface plate 24B of the box 24 is operated to remove the clasp 27A from the hook 31 provided at the free end 28D of the lid member 28 in the state where the hydraulic excavator 1 is stopped when the filler gas is refilled in the accumulator 21. As a result, the lid member 28 is rotated around the center of the hinge member 29 to an open position at which the opening 26 of the box 24 is opened (positions in FIGS. 3 and 6). Therefore, the accumulator 21 mounted on the lid member 28 can externally be taken through the opening 26 of the box 24.

In this case, the box side link 32A and the lid member side link 32B which constitute the link mechanism 32 linearly extend between the box 24 and the lid member 28 when the lid member 28 is rotated to the open position. As a result, the lid member 28 can be held at the open position together with the accumulator 21, and the state of taking the accumulator 21 out of the box 24 can be held. As described above, a gas cylinder (not shown) of a filler gas to be refilled is mounted on the foot rest section 11A of the floor member 11 and transported to a right front side of the operator's seat 12 in the state where the accumulator 21 is taken out of the box 24. Then, the gas filling port 21C of the accumulator 21 and the gas cylinder are connected by a hose to promptly and readily refill the filler gas in the accumulator 21.

The hose is removed from the gas filling port 21C of the accumulator 21 and the link mechanism 32 is folded to rotate the lid member 28 to the closed position around the center of the hinge member 29 after the completion of refilling the filler gas in the accumulator 21. Then, the clasp 27A of the snap lock 27 is latched on the hook 31 of the lid member 28 to accommodate the accumulator 21 in the accommodating space 25 of the box 24 in the state where the lid member 28 reaches the closed position.

Herein, the accumulator 21 is mounted on the lid member 28 using a fixing band 30 in the state where the pressurized oil supply and discharge port 21B is disposed on the hinge member 29 side. Thus, the range of the pressurized oil supply and discharge port 21B of the accumulator 21 to rotate together with the lid member 28 can significantly be suppressed when the lid member 28 rotates around the center of the hinge member 29 between the open position and the closed position. Therefore, high deformation of the hydraulic hose 22 connecting the pressurized oil supply and discharge port 21B of the accumulator 21 and the control valve device 18 as the lid member 28 rotates can be suppressed to guard the hydraulic hose 22.

Therefore, the hydraulic excavator 1 according to the first embodiment includes the self-propelled lower traveling structure 2, the upper revolving structure 4 mounted on the lower traveling structure 2 such that a rear end thereof revolves within a prescribed range relative to the vehicle width of the lower traveling structure 2, and the working mechanism 6 mounted tiltably on a front side of the upper revolving structure 4. The upper revolving structure 4 includes the revolving frame 7 on whose front side the working mechanism 6 is mounted, the counterweight 8 provided on a rear side of the revolving frame 7, the operator's seat 12 disposed on a front side of the counterweight 8, the right front cover 17B disposed from the right side of the operator's seat 12 toward a front end side of the revolving frame 7 and covering equipment mounted on the revolving frame 7, the control valve device 18 controlling supply and discharge of pressurized oil to a plurality of hydraulic actuators, and the accumulator 21 accumulating the pressure of pressurized oil discharged from at least one hydraulic actuator in the plurality of hydraulic actuators and having the pressurized oil supply and discharge port 21B connected to the control valve device 18.

The accumulator support device 23 supporting the accumulator 21 is provided between the operator's seat 12 and the right front cover 17B, and the accumulator support device 23 is configured by the box 24 providing the inside thereof for the accommodating space 25 accommodating the accumulator 21 and having the opening 26 taking the accumulator 21 in and out of the accommodating space 25 and the lid member 28 whose rotating end 28C side is mounted rotatably on the box 24 through the hinge member 29 and whose free end 28D side is opened and closed between the open position at which the opening 26 is opened and the closed position at which the opening 26 is closed, and the accumulator 21 is mounted on the lid member 28 in the state where the pressurized oil supply and discharge port 21B is disposed on the hinge member 29 side.

According to the configuration, a narrow space formed between the operator's seat 12 and the right front cover 17B can effectively be used to dispose the accumulator 21 even if the upper revolving structure 4 is formed in a compact size to achieve rear small-revolution of the hydraulic excavator 1. Further, the accumulator 21 can be guarded from earth and sand or the like during excavating work by accommodating the accumulator 21 in the box 24 in the state where the lid member 28 of the accumulator support device 23 is at the closed position. Meanwhile, the accumulator 21 can be taken out of the box 24 if the lid member 28 only has to rotate around the center of the hinge member 29 to the open position, thereby improving the operational efficiency of maintenance for the accumulator 21.

The accumulator 21 is provided with the gas filling port 21C filling a filler gas, and the accumulator 21 is mounted on the lid member 28 in the state where the gas filling port 21C is disposed on the free end 28D side of the lid member 28. According to the configuration, the gas filling port 21C of the accumulator 21 can be taken out of the box 24 if the lid member 28 only has to rotate around the center of the hinge member 29 from the closed position to the open position. As a result, the gas filling port 21C of the accumulator 21 taken out of the box 24 and the gas cylinder are connected by a hose when the filler gas is refilled in the accumulator 21, thereby promptly and readily refilling the filler gas in the accumulator 21.

Also, the link mechanism 32 holding the lid member 28 at the open position is provided between the box 24 and the lid member 28. According to the configuration, the lid member 28 is held at the open position by the link mechanism 32 to keep the accumulator 21 mounted on the lid member 28 taken out of the box 24. As a result, the efficiency of maintenance operation for the accumulator 21 can be improved.

Further, the accumulator 21 is provided with the pressure gauge 21D displaying the pressure of the filler gas, and the lid member 28 is provided with the opening 28E visually confirming the pressure gauge 21D from the outside of the box 24 when the lid member 28 is at the closed position. According to the configuration, the pressure gauge 21D of the accumulator 21 can readily be confirmed from the outside of the box 24 through the opening 28E in the state where the lid member 28 is at the closed position to accommodate the accumulator 21 in the box 24. Therefore, the filler gas can promptly be refilled in the accumulator 21 even if the pressure of the filler gas declines.

Figure 8:
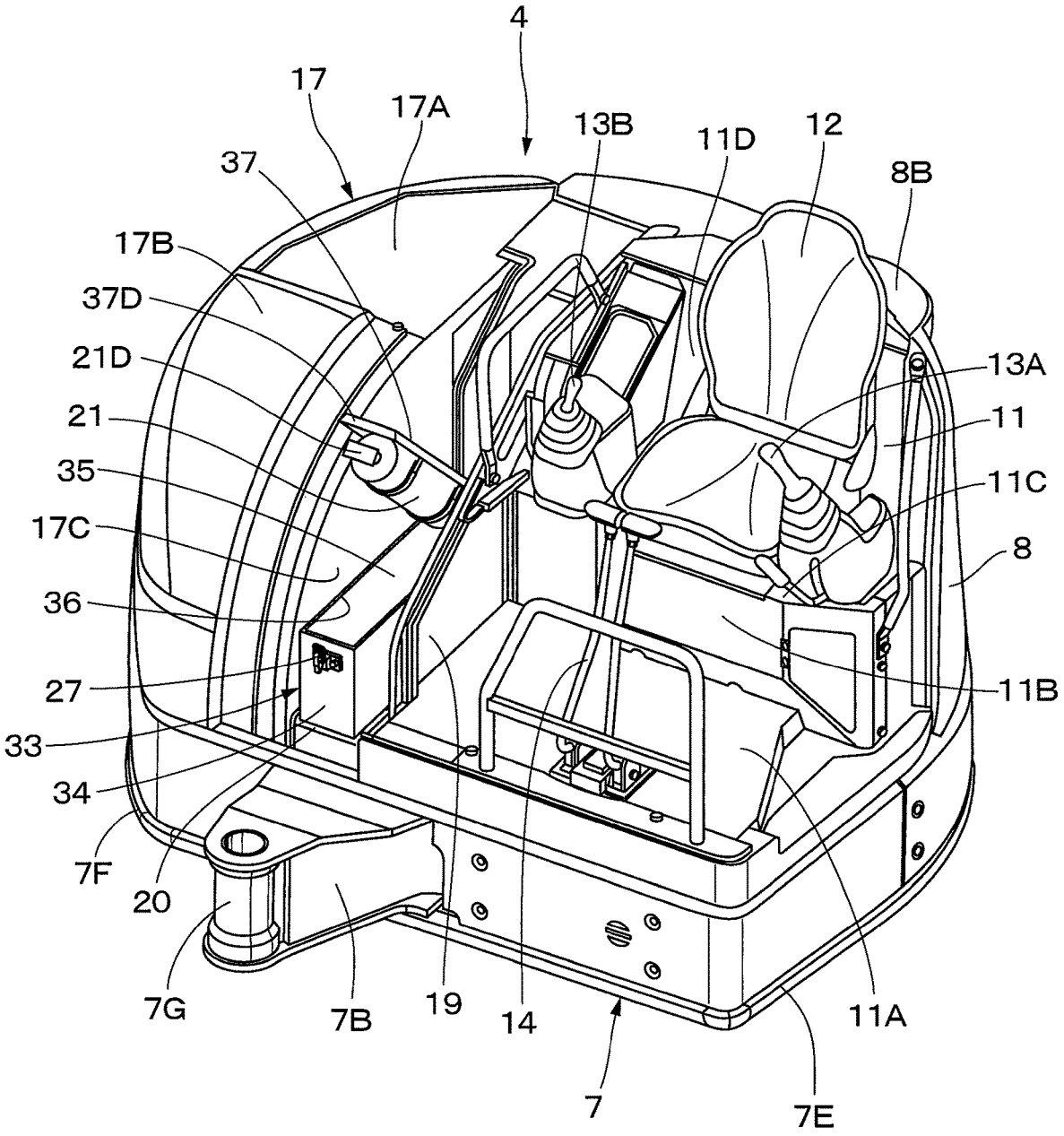
FIG. 8 is a perspective view as in FIG. 3 of an upper revolving structure including an accumulator support device according to a second embodiment in a state where a lid member is at an open position.
Figure 9:
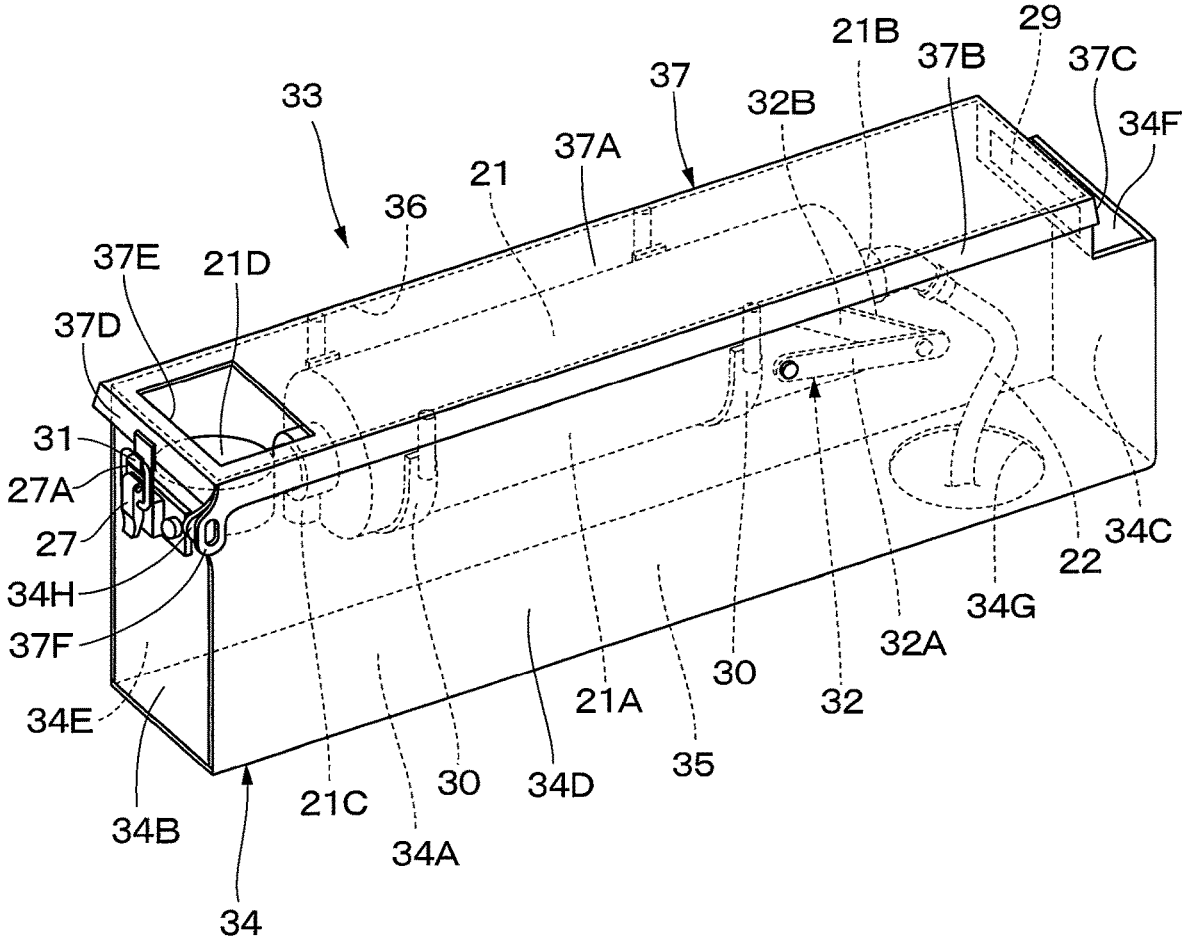
FIG. 9 is a perspective view of the accumulator support device according to the second embodiment in a state where the lid member is at a closed position.
Figure 10:
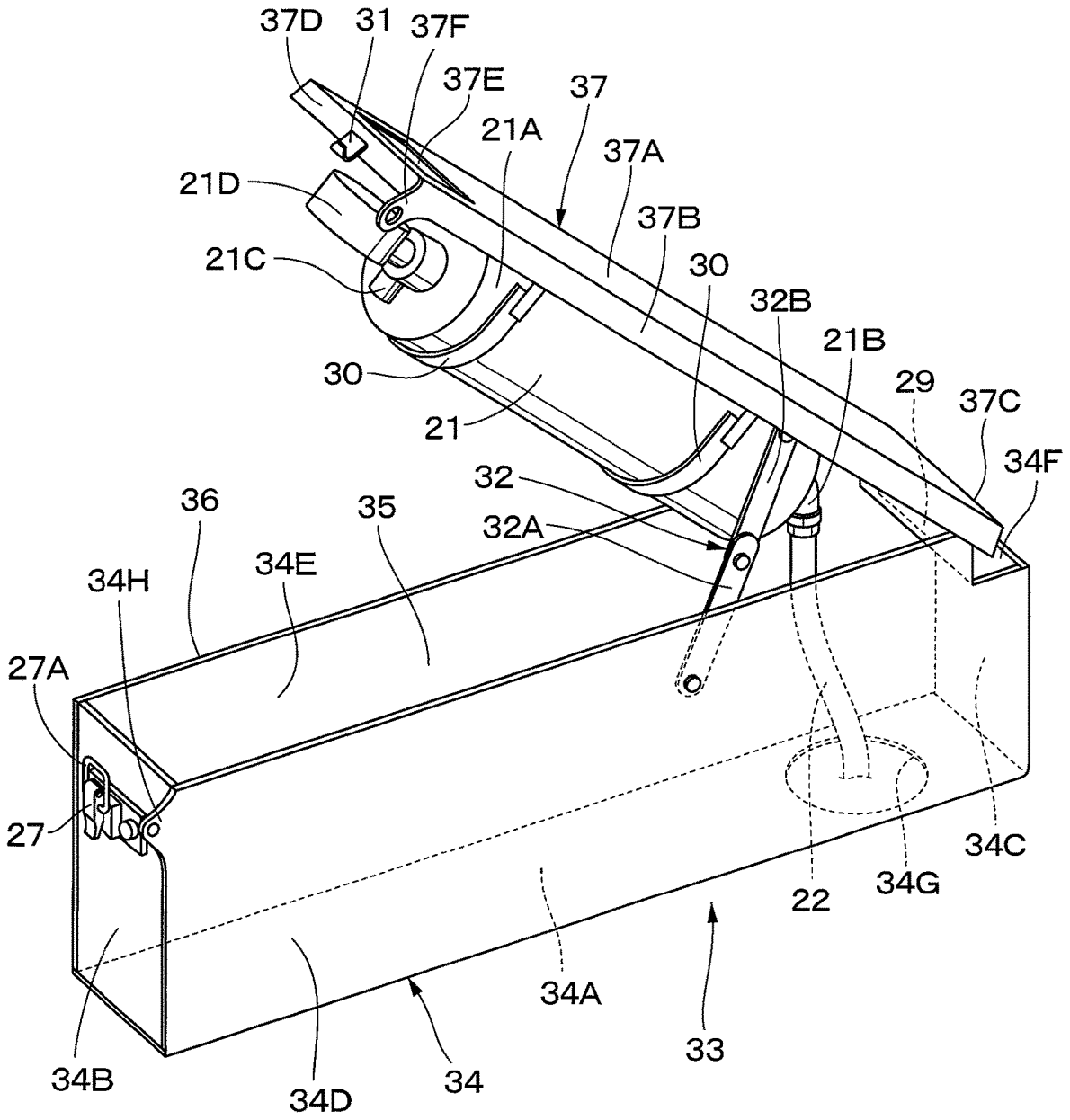
FIG. 10 is a perspective view of the accumulator support device according to the second embodiment in a state where the lid member is at the open position.

Subsequently, FIGS. 8 to 10 illustrate a second embodiment of the present invention. A feature of the second embodiment is that an accumulator support device extending in a front-and-rear direction is provided between an operator's seat and a right front cover. In the second embodiment, the component elements that are identical to those of the foregoing first embodiment will be simply denoted by the same reference numerals to avoid repetitions of similar explanations.

An accumulator support device 33 according to the second embodiment is configured to include a box 34 and a lid member 37 which will be described later, as the accumulator support device 23 in the first embodiment. However, the accumulator support device 33 is different from the one in the first embodiment in that the accumulator support device 33 is provided by horizontally extending in a front-and-rear direction between an operator's seat 12 and a right front cover 17B.

The box 34, which is to be a base of the accumulator support device 33, is fixed on an upper surface of a support base plate 20 and extends in a front-and-rear direction. The box 34 is formed as along rectangular shape in a front-and-rear direction by a bottom plate 34A abutting on the support base plate 20 and extending in a front-and-rear direction, a front plate 34B fixed at a front end of the bottom plate 34A, a rear plate 34C fixed at a rear end of the bottom plate 34A and faced with the front plate 34B in a front-and-rear direction, a left side plate 34D, and a left side plate 34E. The left and right side plates 34D, 34E are faced with each other at an interval in the right-and-left direction to connect the bottom plate 34A, the front plate 34B, and the rear plate 34C. A stepped portion 34F bent forward and upwardly having an L-shape is formed on an upper side of the rear plate 34C.

The box 34 provides the inside thereof for an accommodating space 35, and the accumulator 21 is accommodated in the accommodating space 35. One surface side opposite to the bottom plate 34A of the box 34 is a rectangular-shaped opening 36 surrounded by upper ends of the front plate 34B, the stepped portion 34F of the rear plate 34C, and the left and right side plates 34D, 34E. The accumulator 21 is taken in and out of the accommodating space 35 through the opening 36. A hose insertion hole 34G into which a hydraulic hose 22 is inserted is formed on the bottom plate 34A of the box 34. Meanwhile, a snap lock 27 is mounted on the front plate 34B of the box 34, and a box side projecting piece 34H having a bolt insertion hole is provided on a front side of an upper end portion of the left side plate 34D of the box 34.

The lid member 37 is mounted on the box 34 capable of opening and closing the opening 36. The lid member 37 is configured by a body portion 37A composed of a rectangular plate and a peripheral wall section 37B surrounding the periphery of the body portion 37A and projected on the box 34 side. A rotating end 37C is at one end in the length direction of the lid member 37 (rear end), and the rotating end 37C and the stepped portion 34F of the box 34 are connected by the hinge member 29. Therefore, the lid member 37 is mounted on the box 34 through the hinge member 29, and the free end 37D side of the lid member 37 can rotate around the center of the hinge member 29 between a closed position (position in FIG. 9) where the opening 36 of the box 34 is closed and an open position (positions in FIGS. 8 and 10) where the opening 36 is opened.

The accumulator 21 is fixed on an inner surface of the lid member 37 as the box 34 side using a fixing band 30. Therefore, the accumulator 21 is accommodated in the accommodating space 35 of the box 34 when the lid member 37 is at the closed position, and the accumulator 21 is taken out of the box 34 through the opening 36 when the lid member 37 is at the open position. In this case, the accumulator 21 is mounted on the lid member 37 in the state where a pressurized oil supply and discharge port 21B is disposed on the hinge member 29 side.

Meanwhile, a rectangular opening 37E is formed at a position corresponding to the pressure gauge 21D in the lid member 37 in the state where the accumulator 21 is mounted on the lid member 37, and the pressure gauge 21D of the accumulator 21 can visually be confirmed from the outside of the box 34 through the opening 37E. A hook 31 corresponding to the snap lock 27 mounted on the front plate 34B of the box 34 is fixed at the free end 37D of the lid member 37. A lid member side projecting piece 37F having a bolt insertion hole is provided at a position corresponding to the box side projecting piece 34H provided on the left side plate 34D of the box 34 in the free end 37D of the lid member 37.

A link mechanism 32 having a box side link 32A and a lid member side link 32B is provided between the box 34 and the lid member 37. The box side link 32A and the lid member side link 32B of the link mechanism 32 linearly extend between the box 34 and the lid member 37, and holds the extension by a stopper (not shown) when the lid member 37 is rotated to the open position shown in FIG. 10. As a result, the lid member 37 on which the accumulator 21 is mounted can be held at an open position by the link mechanism 32.

The accumulator support device 33 according to the second embodiment is configured as described above, and the accumulator support device 33 can also achieve the same operational advantage as the accumulator support device 23 according to the first embodiment.

In the embodiment, a canopy type hydraulic excavator 1 including a canopy 16 covering an operator's seat 12 from an upper side was exemplified. However, the present invention is not limited to that, and it can also be applied to a hydraulic excavator including a box-shaped cab surrounding an operator's seat 12 or the like. In this case, an accumulator support device can be provided between a right front cover 17B of an exterior cover 17 and a right side surface of a cab to perform maintenance operation for an accumulator 21 from a front side of an upper revolving structure.

Also, in the embodiment, the use of a link mechanism 32 including a box side link 32A and a lid member side link 32B was exemplified as an open position retaining mechanism holding a lid member 28 (37) at an open position. However, the present invention is not limited to that, and the open position retaining mechanism may be configured by another member such as a bar-shaped member (brace rod member) bridged between the box 24 and the lid member 28 when a lid member 28 (37) is at an open position.

In the first embodiment, a case where the inclination angle of the lid member 28 relative to the vertical direction is constant by a link mechanism 32 when the lid member 28 is at an open position was exemplified. However, the present invention is not limited to that, and the inclination angle may be variable when the lid member 28 is at the open position. This also applies to the second embodiment.

In the embodiments, the use of a hinge member 29 as a connecting member rotatably connecting a lid member 28 (37) to a box 24 (34) was exemplified. However, the present invention is not limited to that, and a lid member and a box may be configured to be rotatably connected using e.g., a pin.

Further, in the first embodiment, an accumulator support device 23 extending perpendicular to the vertical direction was exemplified, and in the second embodiment, an accumulator support device 33 horizontally extending in a front-and-rear direction was exemplified. However, the present invention is not limited to that, and the accumulator support device may be configured to have a predetermined inclination angle relative to the vertical or horizontal direction.

DESCRIPTION OF REFERENCE NUMERALS

2: Lower traveling structure
4: Upper revolving structure
6: Working mechanism
7: Revolving frame
8: Counterweight
12: Operator's seat
17B: Right front cover
18: Control valve device
21: Accumulator
21B: Pressurized oil supply and discharge port
21C: Gas filling port
21D: Pressure gauge
23, 33: Accumulator support device
24, 34: Box
25, 35: Accommodating space
26, 36: Opening
28, 37: Lid member
28C, 37C: Rotating end
28D, 37D: Free end
28E, 37E: Opening
29: Hinge member (Connecting member)
32: Link mechanism (Open position retaining mechanism)

The invention claimed is:

1. A hydraulic excavator comprising:

a self-propelled lower traveling structure;

an upper revolving structure mounted rotatably on the lower traveling structure; and a working mechanism mounted tiltably on a front side of the upper revolving structure;

the upper revolving structure comprising:

a revolving frame on whose front side the working mechanism is mounted;

an operator's seat disposed on a front side of the revolving frame;

a right front cover disposed from the right side of the operator's seat toward a front end side of the revolving frame and covering equipment mounted on the revolving frame;

a control valve device controlling supply and discharge of pressurized oil to a plurality of hydraulic actuators provided on the lower traveling structure, the upper revolving structure and the working mechanism; and an accumulator accumulating the pressure of the pressurized oil discharged from at least one hydraulic actuator in the plurality of hydraulic actuators and having a pressurized oil supply and discharge port connected to the control valve device through a hydraulic hose, wherein an accumulator support device supporting the accumulator is provided between the operator's seat and the right front cover, the accumulator support device is configured by a box providing the inside thereof for an accommodating space accommodating the accumulator and having an opening taking the accumulator in and out of the accommodating space and a lid member is rotatably connected to the box and opened and closed between an open position at which the opening is opened and a closed position at which the opening is closed, wherein the lid member whose one end is a rotating end rotatably connected to the box by a connecting member and a free end opposite to the rotating end is provided with a hook that can be latched on the box when the lid member is at the closed position, and the accumulator is configured to be mounted on the lid member in the state where the pressurized oil supply and discharge port is disposed on a side of the rotating end of the lid member.

2. The hydraulic excavator according to claim 1, wherein the accumulator is provided with a gas filling port filling a filler gas, and the accumulator is mounted on the lid member in the state where the gas filling port is disposed on the side of the free end side of the lid member.

3. The hydraulic excavator according to claim 1, wherein an open position retaining mechanism holding the lid member at the open position is provided between the box and the lid member.

4. The hydraulic excavator according to claim 1, wherein the accumulator is provided with a pressure gauge displaying the pressure of a filler gas, and the lid member is provided with an opening visually confirming the pressure gauge from the outside of the box when the lid member is at the closed position.

* * * * *